United States Patent [19]

Kopsho, Jr.

[11] Patent Number: 4,520,242

[45] Date of Patent: May 28, 1985

[54] JOYSTICK

[75] Inventor: Joseph D. Kopsho, Jr., San Marcos, Calif.

[73] Assignee: Kraft Systems, Inc., Vista, Calif.

[21] Appl. No.: 473,781

[22] Filed: Mar. 10, 1983

[51] Int. Cl.[3] ..... H01H 19/00

[52] U.S. Cl. ..... 200/6 A; 200/159 R

[58] Field of Search ..... 200/6 A, 61.76, 159 R, 200/5 A, 17 R

[56] References Cited

U.S. PATENT DOCUMENTS

| | | | |
|---|---|---|---|
| 1,775,306 | 9/1930 | Cantwell | 200/6 A |
| 1,825,991 | 10/1931 | Bobroff | 200/6 A |
| 2,808,476 | 10/1957 | Elliott | 200/6 A |
| 3,288,970 | 11/1966 | Perez | 200/159 R |
| 3,699,276 | 10/1972 | Atakkaan | 200/159 R |
| 3,917,918 | 11/1975 | Vannest | 200/6 A |
| 3,940,585 | 2/1976 | Schaad | 200/159 R |
| 4,408,103 | 10/1983 | Smith | 200/6 A |

*Primary Examiner*—E. A. Goldberg
*Assistant Examiner*—M. Reinhart
*Attorney, Agent, or Firm*—Christie, Parker & Hale

[57] ABSTRACT

A joystick is disclosed comprising a swtich holder having four side walls and an opening at its top. Each side wall has a switch opening. Four panel-mounted type switches having depressible activator buttons are mounted in the switch openings with the activator buttons extending into the interior of the switch holder. The joystick comprising an actuator arm having a handle, a ball, and a switch engaging member. The ball is rotatably mounted above the switches. The handle extends upwardly from the ball and the switch engaging member extends downwardly into the switch holder to a position between all of the activator buttons of the switches.

10 Claims, 4 Drawing Figures

JOYSTICK

FIELD OF THE INVENTION

This invention relates to control stick assemblies or joysticks which activate electrical circuits in response to the direction and displacement of a movable handle.

BACKGROUND OF THE INVENTION

Control stick assemblies, commonly referred to as joysticks, are used to generate electrical signals representative of the direction of the movement of a movable actuator arm handle. Such joysticks are used as computer display cursor controls, radio controls for model airplanes and radio controlled toys and the like.

There are basically two varieties of joysticks. In the first variety, the actuator arm handle is typically connected to the input shafts of a pair of orthogonally positioned potentiometers or the like so that displacement of the actuator arm handle rotates one or both of the input shafts.

In the second variety, the joystick typically comprises four or more on-off switches. The actuator arm handle is connected to the switches so that sufficient displacement of the actuator arm handle activates one or more of the switches.

The second variety of joysticks are generally the variety that is used as display cursor controls for video games. With the increased interest in video games, there has become a constant commercial demand for reducing the production cost of video game computers and their accessories, which includes joysticks.

SUMMARY OF THE INVENTION

This invention provides a joystick comprising four panel-mounted type switches having a depressible activator button. The panel-mounted type switches are mounted in a four-sided switch holder so that the activator buttons extend into the interior of the switch holder.

The joystick further comprises an actuator arm which is pivotally mounted above the activator buttons of the switches at a pivot position between its ends. The actuator arm has a switch engaging member extending downwardly into the space between the activator buttons and a handle extending upwardly from the pivot position.

Movement of the handle in one direction results in displacement of the switch engaging member generally in the opposite direction. Therefore, movement of the handle in a direction directly away from a specific switch results in displacement of the switch engaging member toward the switch and against the activator button. When the activator button is sufficiently depressed by displacement of the switch engaging member, the switch is activated. Movement of the handle away from two adjacent switches results in the activation of both switches.

A preferred joystick comprises four panel-mounted type switches having depressible activator buttons which are mounted in a four-sided switch holder having upwardly converging walls so that the activator buttons extend into the interior of the switch holder. The joystick comprises a socket above the switches. A ball is mounted in the socket and afforded rotational movement in the socket. A switch engaging member, comprising a connecting shaft with an enlarged foot at its bottom, extends downwardly from the ball into the space between the activating buttons of the switches. A handle extends upwardly from the ball.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

Figure 3:
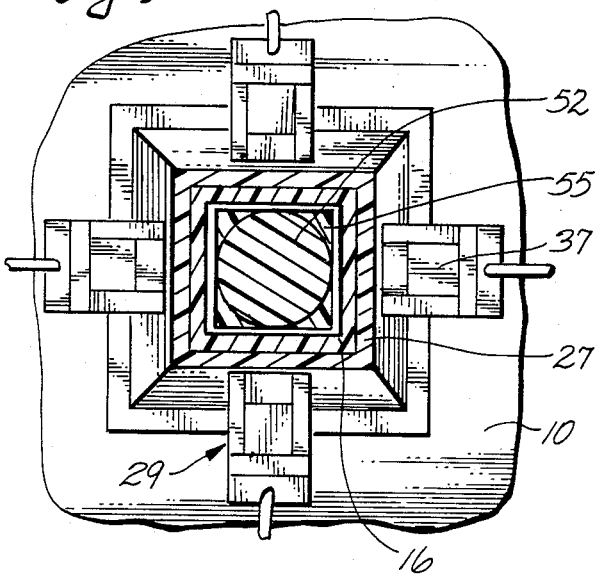
FIG. 3 is a top cross-sectional view of the joystick of FIG. 1 along 3—3.
Figure 2:
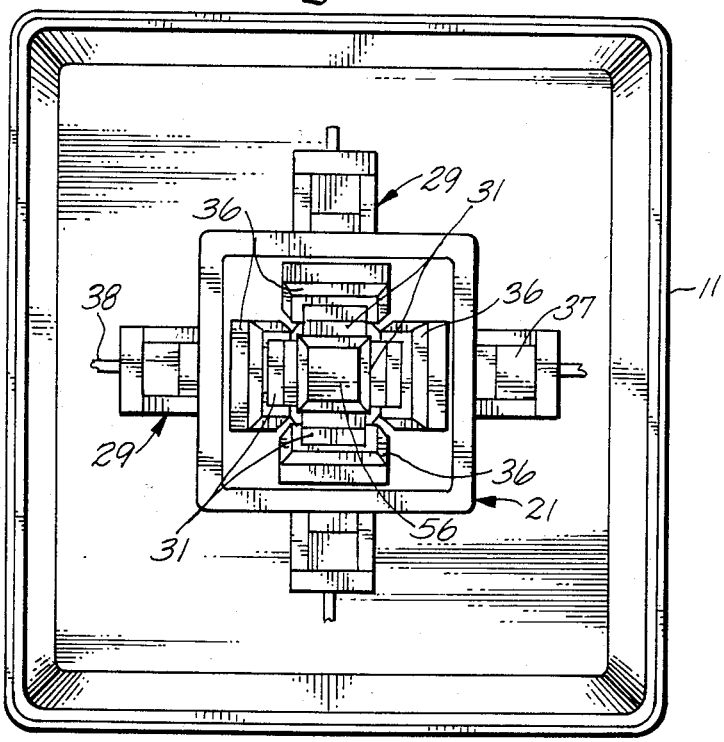
FIG. 2 is a bottom view of the joystick of FIG. 1 along line 2—2.

A preferred joystick constructed in accordance with the present invention is shown in FIGS. 2 and 3. The joystick comprises a housing 10 having a top panel 11 and a bottom panel 12.

The top panel 11 has a truncated pyramidal recess 13 with a generally circular control stick access opening 14 at its apex. The control stick access opening 14 is generally conical, extending downwardly and outwardly toward the sides of the top panel 11. A four-sided generally square-shaped upper guide 16 extends downwardly from the truncated pyramidal recess 13 around the control stick access opening 14.

The bottom panel 12 comprises four ribs 17 protruding upwardly from the bottom panel. The ribs 17 extend generally parallel to the sides of the bottom panel and join to form a generally square-shaped lower guide 18 which is centered on the bottom panel.

The joystick further comprises a switch holder 21 having four upwardly converging side walls 22, which extend from a generally square base. Each side wall has a generally square switch opening 23.

The base of the switch holder is slightly smaller than the lower guide of the bottom panel and is fitted within the lower guide which thereby prevents lateral movement of the base of the switch holder and, in addition, centers the switch holder in the housing.

The switch holder 21 comprises a generally horizontal flange 24 extending inwardly along the top edge of each side wall 22. The inner edge of the horizontal flanges 24 form a generally circular opening 26 into the interior of the switch holder. The opening 26 into the interior of the switch holder is conical, extending upwardly and outwardly.

The switch holder 21 also comprises short generally vertical flanges 27 extending upwardly along the top edges of the side walls 22. The vertical flanges 27 form a generally square-shaped recess 28 at the top of the switch holder 21. The recess 28 is slightly larger than the upper guide 16 of the top panel 11.

The switch holder 21 is mounted in the housing 10 such that the base of the switch holder 21 is fitted within the lower guide 18 of the bottom panel 12. The switch holder 21 extends upwardly to a position wherein the upper guide 16 of the top panel 11 extends into the square recess 28 of the switch holder and the bottom edge of the upper guide 16 abuts the horizontal flange 24 of the switch holder. In this arrangement, the upper and lower guides prevent lateral movement of the switch holder. The upper guide, along with the bottom panel, prevents vertical movement of the switch holder.

The upper guide 16 and the truncated pyramidal recess 13 of the top panel along with the horizontal flange 24 of the switch holder form a ball compartment 19 having an opening, at its top, i.e., the control stick access opening 14, and an opening at its bottom, i.e., the opening 26 into the interior of the switch holder.

A panel-mounted push-button switch, i.e., a switch having a depressible activator button 31, is mounted in the switch opening 23 of each side wall of the switch holder so that the activating button 31 extends into the interior of the switch holder. The panel-mounted push-button switches 29 are connectable to a signal generating source and may be of any conventional design as is well known in the art.

Figure 1:
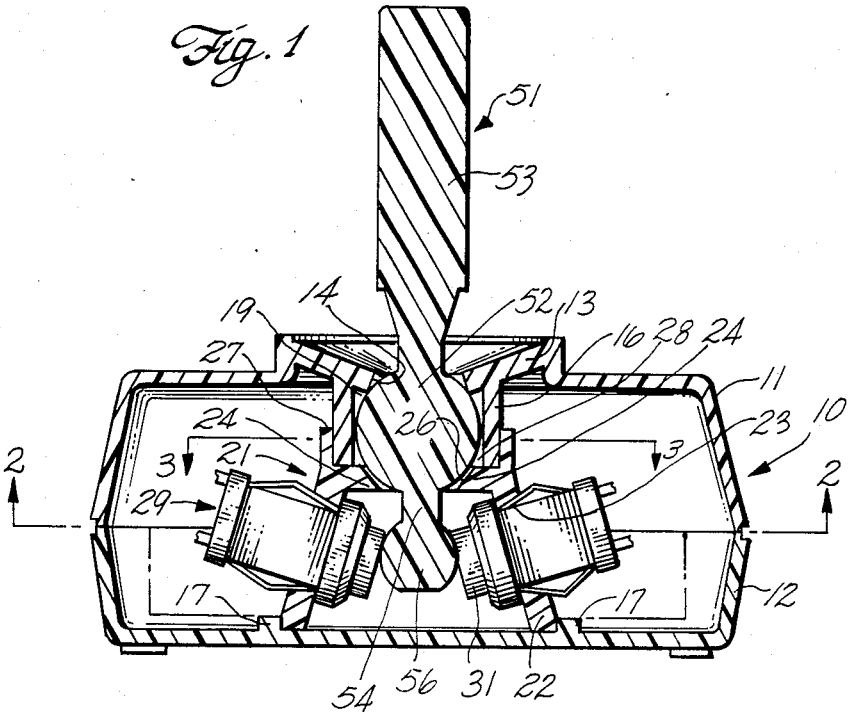
FIG. 1 is a cross-sectional view of an exemplary joystick.
Figure 4:
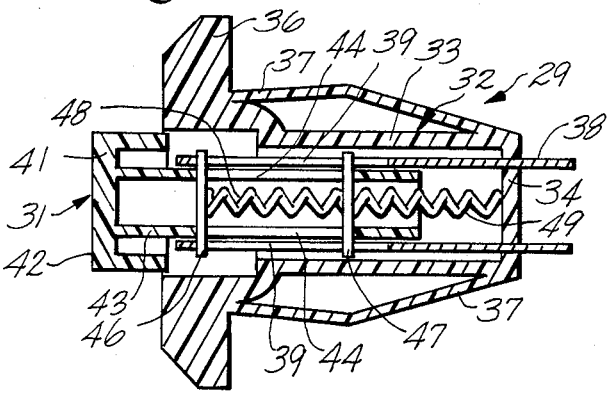
FIG. 4 is a cross-sectional view of a switch applicable to this invention.

With reference to FIG. 4, there is shown an exemplary panel-mounted push-button switch applicable to this invention. The switch 29 has a switch housing 32 having four side walls 33 and one end wall 34. The switch housing 32 is thus open at one end and closed at the other end. The switch housing 32 has a flange 36 along the edge of the side walls 33 at its open end and a pair of retention clips 37 on two opposing side walls.

A pair of fixedly mounted electrical contacts 38 extend the length of the interior of the switch housing 32, through the end wall 34 and extend outwardly from the closed end of the switch housing. Each electrical contact 38 has a slot 39 along a portion of the length of the electrical contact within the interior of the switch housing. The ends of the electrical contacts protruding from the switch housing are connectable to an electrical generating source by wires or the like.

An activator button 31, having a generally square head 41 with a flat face 42 and a hollow, generally cylindrical body 43 is positioned in the switch housing and afforded lengthwise movement in the switch housing. The body 43 of the activator button 31 comprises a slotted opening 44. The slotted opening 44 in the body 43 is shorter than the slot 39 in the electrical contacts 38.

A rigid non-conductive rod 46 extends through the slotted opening 44, at the end of the slotted opening nearest the head 41, and protrudes from each side of the body 43. A rigid conductive rod 47 extends through the slotted opening 44, at the end of the slotted opening remote from the head 41, and also protrudes from each side of the body 43. The rods 46 and 47 are maintained at the respective ends of the slotted opening 44 by a first spring 48 which is disposed in the interior of the body 43 between the non-conductive rod 46 and the conductive rod 47.

The activator button 31 is mounted in the switch housing so that the ends of the non-conductive and conductive rods protruding from the body 43 of the activator button 31 are captured in the slots 39 of the electrical contacts 38. The slots 39 in the electrical contacts are wider than either the non-conductive or conductive rods so that the rods can only make contact with the electrical contacts at the ends of the slots 39.

A second spring 49 is disposed in the switch housing and extends from the end wall 34 of the switch housing into the end of the body of the activator button and abuts to the conductive rod 48. The second spring provides a force which maintains the activator button in the extended position wherein the non-conductive rod contacts the ends of the slots in the electrical contacts nearest the head of the activator button when a force depressing the activator button greater than the force generated by the second spring is absent.

In the extended position, the face 42 of the activator button 31 is spaced apart from the flange 36 of the switch housing and is generally parallel to the side wall of the switch holder 21. The activator button 31 is depressible against the force of the second spring 49 from the extended position to a first depressed position wherein the conductive rod 47 contacts both electrical contacts at the end of the slots 39 thereby completing an electrical circuit through the switch. The activator button can be futher depressed to a second depressed position against the force of both the first spring 48 and second spring 49 wherein the face 42 of the push button is generally flush with the flange 36.

Again with reference to FIGS. 2 and 3, the joystick comprises a rigid actuator arm 51 comprising a ball 52 having a diameter greater than either the diameter of the control stick access opening 14 and the circular opening 26 into the interior of the switch holder 21. The ball comprises four generally triangular projections 55 extending horizontally from the horizontal circumference of the ball. The four projections form a generally square perimeter around the horizontal center of the ball. The sides of the square perimeter are generally parallel with the vertical flanges 27 and the sides of the upper guide 16.

The ball 52 is mounted in the ball compartment 19 such that the control stick access opening 14 forms an upper socket and the opening 26 into the interior of the switch holder forms a lower socket for the ball. The ball 52 is held in place by the sockets and is afforded rotational movement within the ball compartment 19 along the horizontal axes of the ball that are generally normal to the sides of the square perimeter. The generally triangular projections 55 prevent rotation of the ball around its vertical axis.

A movable handle 53 extends upwardly from the ball 52 through the control stick access opening 14. Extending downwardly from the ball 52 into the interior of the switch holder is a connecting shaft 54. At the bottom of the connecting shaft is an enlarged foot 56. The foot 56 is sufficiently small to allow the foot to pass through the circular opening 26 into the interior of the switch holder during assembly.

The foot 56 is generally square-shaped, having a generally flat top and bottom and four generally convex sides. The maximum horizontal cross-sectional area of the foot 56 is larger than the opening between the top edges of the activator buttons of the switches. As a result, the foot can only be inserted into the space between the activator button during assembly by depressing one or more of the buttons. The foot is therefore captured in the space between the buttons. The four sides of the foot engage the four activator buttons 31 and slightly depress the activator buttons 31. The activator buttons are depressed sufficiently to provide a slight force, generated by the springs in the switches, against the foot for centering the foot between the switches but are not depressed sufficiently to activate the switches.

Movement of the handle 53 results in rotation of the ball 52 and displacement of the connecting shaft 54 and foot 56 in a direction generally opposite the direction of movement of the handle 33. Therefore, movement of the handle from a generally neutral vertical position in a direction directly away from a select panel-mounted switch, i.e., a direction away from a switch generally along the vertical plane of the longitudinal axis of the switch, results in displacement of the foot in a direction toward that switch and depression of the activator button of that switch against the force of the first and second springs. When the handle is released, the force generated by the first and second springs of the switch causes the actuator arm button to return to the extended position, thereby returning the handle to its generally vertical neutral position.

Similarly, if the handle is moved in a direction away from two adjacent switches, i.e., switches mounted on adjoining side walls of the switch holder, which occurs when the handle is moved in a direction between the vertical planes of the longitudinal axes of two adjacent switches, the foot engages and depresses the activator buttons of both switches. The joystick of the present invention has the capability of activating a single electrical circuit or, depending on the direction that the handle is moved, of activating the electrical circuits associated with two adjacent switches.

One of the unique advantages of a joystick made in accordance with this invention is the ease of assembly. To assemble the joystick, the panel-mounted switches 29 are inserted through the switch openings 23 in the side walls of the switch holder 21 and snapped into place against the force of the retaining clip 37 so that the flanges 36 of the switch housings 21 are flush against the inner surfaces of the side walls 33.

Appropriate electrical connections are then made with the electrical contacts 38 extending outwardly from the end walls of the panel-mounted switch 21.

The foot 56 and connecting shaft 54 of the actuator arm 51 are then inserted through the opening 26 at the top of the switch holder 21 and the activator buttons 31 of the switches are depressed sufficiently to allow the foot 56 to be positioned in the space between the actuator arm buttons. The actuator arm buttons are then released, thereby capturing the foot and exerting a slight downward and inward force on the foot, which maintains the ball in a position against the opening into the switch holder and the handle in the generally vertical, neutral position.

The switch holder is positioned on the bottom panel so that the base of the switch holder is within the lower guide of the bottom panel. The top panel is then fitted over the switch holder with the handle of the actuator arm extending through the access opening and the upper guide extending into the recess at the top of the switch holder.

The preceding description has been presented with reference to a preferred embodiment of the invention shown in the accompanying drawings. It is apparent that changes and modifications in the described structures and designs can be practiced without departing from the scope of the invention. For example, the side walls of the switch housing need not be upwardly converging to form a pyramidal-shaped switch holder. Generally vertical side walls or even side walls that are slightly upwardly divergent can be used. While such a design does not allow the activator buttons to provide a downward force on the foot of the actuator arm stick to thereby capture the foot, which facilitates assembly, it is otherwise functional.

Further, the actuator arm need not comprise an enlarged foot at the bottom of the connecting shaft. An extension of the connecting shaft or any other rigid member for engaging the activator buttons of the switches is applicable. The foot or other switch engaging member of the actuator arm which depresses the activating buttons of the switches in response to movement of the handle need not slightly depress the activating buttons of the switches when the handle is in the neutral position. Rather, the sides of the foot or the switch engaging member can be simply adjacent the activator buttons or there can be a gap between the activator buttons and the sides of the foot.

In addition, it is apparent that any conventional push-button-type switch can be used in the practice of this invention.

It is also apparent that this invention is applicable to the construction of a "paddle", i.e., a joystick which comprises only two opposingly mounted switches and in which the handle is only movable along a single axis. In such a device, the switch holder comprises two generally vertical, spaced apart opposing side walls, each having a switch opening in which the panel-mounted switches are mounted. The device would be otherwise similar to the more widely used four-switch joystick.

In addition to the ease of assembly, which reduces production cost, this invention provides the advantage of being able to utilize low cost, commercially available panel-mounted push-button switches, which further reduces the cost of production. Moreover, the same type of push-button switch can be used as a firing button for example in applications wherein the joystick is used as a control for video games which require such a firing button.

What is claimed is:

1. A joystick comprising:

a switch holder having four side walls and an opening at its top, each side wall having a switch opening;

four panel-mounted switches for activating an electrical circuit associated with that switch, each switch being mounted in the switch opening of a side wall of the switch holder, and each switch comprising:

an activator button depressible from an extended position wherein the electrical circuit associated with the switch is not activated to a fully depressed position wherein the electrical circuit is activated, said activator button extending into the interior of the switch holder;

spring means for urging the activator button toward the extended position;

an actuator arm comprising:

a ball rotatably mounted at a position above the opening in the top of the switch holder;

a handle extending upwardly from the ball and movable from a generally vertical neutral position; and a switch engaging member extending downwardly from the ball through the opening into the interior of the switch holder and wherein the switch engaging member is centered between and slightly depresses all of the activator buttons of the switches when the handle is in the neutral position.

2. A joystick as claimed in claim 1 wherein the activator buttons comprise a generally flat face for engaging the switch engaging member and the flat faces of the activator buttons are upwardly converging.

3. A joystick as claimed in claim 2 wherein the switch engaging member comprises an enlarged foot which is captured by the upwardly converging faces of the activator buttons.

4. A joystick as claimed in claim 1 further comprising means for preventing rotation of the ball about its vertical axis.

5. A joystick comprising:

a switch holder having four side walls and an opening at its top, each side wall having a switch opening;

four panel-mounted switches for activating an electrical circuit associated with that switch, each switch being mounted in the switch opening of a side wall of the switch holder, and each switch comprising:

an activator button depressible from an extended position wherein the electrical circuit associated with the switch is not activated to a fully depressed position wherein the electrical circuit is activated, said activator button extending into the interior of the switch holder and having a generally flat face which extends upwardly and toward the center of the switch holder so that the faces of the activator buttons of the four switches are upwardly converging;

spring means for urging the activator button toward the extended position;

an actuator arm comprising:

a ball rotatably mounted at a position above the opening in the top of the switch holder;

a handle extending upwardly from the ball and movable from a generally vertical neutral position; and a switch engaging member extending downwardly from the ball through the opening into the interior of the switch holder for engaging each of the faces of the switch activator buttons.

6. A joystick as claimed in claim 5 wherein the switch engaging member slightly depresses the activator buttons when the handle is in the neutral position.

7. A joystick as claimed in claim 5 wherein the switch engaging member comprises an enlarged foot which is captured by the upwardly converging faces of the activator buttons.

8. A joystick as claimed in claim 5 further comprising means for preventing rotation of the ball about its vertical axis.

9. A joystick comprising:

a switch holder having four side walls and an opening at its top, each side wall having a switch opening;

four panel-mounted switches for activating an electrical circuit associated with that switch, each switch being mounted in the switch opening of a side wall of the switch holder, and each switch comprising:

an activator button depressible from an extended position wherein the electrical circuit associated with the switch is not activated to a fully depressed position wherein the electrical circuit is activated, said activator button extending into the interior of the switch holder and having a generally flat face which extends upwardly and toward the center of the switch holder so that the faces of the activator buttons of the four switches are upwardly converging;

spring means for urging the activator button toward the extended position;

an actuator arm comprising:

a ball rotatably mounted at a position above the opening in the top of the switch holder;

a handle extending upwardly from the ball and movable from a generally vertical neutral position; and a switch engaging member extending downwardly from the ball through the opening into the interior of the switch holder and comprising an enlarged foot which is captured by and which slightly depresses each of the faces of the switch activator buttons.

10. A joystick as claimed in claim 9 further comprising means for preventing rotation of the ball about its vertical axis.

* * * * *